US008758029B2

(12) United States Patent
Midorikawa

(10) Patent No.: US 8,758,029 B2
(45) Date of Patent: Jun. 24, 2014

(54) ELECTRICAL CONNECTOR

(75) Inventor: Kazuya Midorikawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 9 days.

(21) Appl. No.: 13/397,082

(22) Filed: Feb. 15, 2012

(65) Prior Publication Data

US 2012/0214353 A1 Aug. 23, 2012

(30) Foreign Application Priority Data

Feb. 17, 2011 (JP) ..... 2011-031566

(51) Int. Cl.
*H01R 12/00* (2006.01)

(52) U.S. Cl.
USPC ..... 439/74

(58) Field of Classification Search
USPC ..... 439/74, 626, 570, 733.1
See application file for complete search history.

(56) References Cited

U.S. PATENT DOCUMENTS

| | | | | |
|---|---|---|---|---|
| 7,172,433 | B2 * | 2/2007 | Tsai | 439/74 |
| 7,465,171 | B2 * | 12/2008 | Miyazaki et al. | 439/74 |
| 7,744,377 | B2 * | 6/2010 | Wu et al. | 439/74 |
| 7,748,993 | B2 * | 7/2010 | Midorikawa et al. | 439/74 |
| 7,758,352 | B2 * | 7/2010 | Zeng | 439/74 |
| 7,985,099 | B2 * | 7/2011 | Wu | 439/626 |
| 7,993,146 | B2 * | 8/2011 | Midorikawa | 439/74 |
| 8,267,698 | B2 * | 9/2012 | Ishikawa et al. | 439/17 |
| 2005/0101163 | A1 * | 5/2005 | Obikane et al. | 439/74 |
| 2006/0040525 | A1 * | 2/2006 | Takano et al. | 439/74 |
| 2006/0051988 | A1 * | 3/2006 | Okura et al. | 439/74 |
| 2007/0141866 | A1 * | 6/2007 | Kishi et al. | 439/74 |
| 2009/0061655 | A1 * | 3/2009 | Miyazaki et al. | 439/74 |

FOREIGN PATENT DOCUMENTS

| | | | |
|---|---|---|---|
| JP | 61-044778 | U | 3/1986 |
| JP | 2007-035291 | A | 2/2007 |
| JP | 2009-217943 | A | 9/2009 |

* cited by examiner

*Primary Examiner* — Alexander Gilman
(74) *Attorney, Agent, or Firm* — Kubotera & Associates, LLC

(57) ABSTRACT

An electrical connector to be connected to a mating connector includes a housing formed of an insulation material; and a terminal disposed in the housing. The terminal is formed in a curved shape bent in a thickness direction thereof. The terminal includes a held portion fixed to the housing, an elastic arm portion, and a connection portion to be connected to a circuit board. The elastic arm portion includes a contact portion and a slant surface portion. The slant surface portion has a thickness decreasing toward a distal end portion of the elastic arm portion, and the contact portion is disposed adjacent to the slant surface portion.

6 Claims, 3 Drawing Sheets

ELECTRICAL CONNECTOR

BACKGROUND OF THE INVENTION AND RELATED ART STATEMENT

The present invention relates to an electrical connector including a terminal. The terminal is formed by bending a metal strip in a thickness direction thereof.

A conventional electrical connector (a connector) is disclosed in Patent Reference. In the conventional electrical connector disclosed in Patent Reference, a terminal of the connector has a shape of an approximate S-shape combining a U-shape portion with an upside-down U-shape portion. The upside-down U-shape portion or a held portion of the terminal is disposed from an upper direction in a circumferential wall of a housing. The U-shape portion of the terminal includes a contact portion for contacting with a mating terminal of a mating connector.

Patent Reference: Japanese Patent Publication No. 2007-035291

In the conventional electrical connector disclosed in Patent Reference, the housing includes a central wall rising from a bottom wall thereof in a region surrounding by the circumferential wall. The central wall includes a terminal holding groove. The U-shape portion of the terminal is situated along an inner surface of the housing, in other words, from an inner surface of the circumferential wall to a surface of the central wall, through the bottom wall. The U-shape portion has elasticity.

In particular, an elastic arm portion is provided in a portion rising along the surface of the central wall. Most part of the elastic arm portion is situated in the terminal holding groove. The elastic arm portion includes a contact portion at a distal end portion thereof. The contact portion protrudes toward the held portion. The contact portion is formed by bending the distal end portion into an angular shape so that an apex portion of the angular shape is situated outside the terminal holding groove.

When the conventional connector is connected to the mating connector from the upper direction, the apex portion of the contact portion is pressed by the mating terminal, thereby the elastic arm portion is displaced elastically in a direction perpendicular to a direction the connectors are connected (a connecting direction). Accordingly, the contact portion contacts with the mating terminal with a certain contact pressure.

The conventional connector disclosed in Patent Reference is soldered to a circuit board so that the bottom wall thereof is placed on the circuit board. Electronic components including the connector are loaded on an electrical device in a state of being mounted on the circuit board. Therefore, it is demanding to lower a height of the electronic component. Accordingly, the connector needs to have a low height in the connecting direction. Therefore, it is important to shorten the elastic arm portion while maintaining the contact pressure at the contact portion, since the terminal governs the height of the connector most effectively.

In the conventional connector disclosed in Patent Reference, the terminal has a certain height, in other words, the elastic arm portion has a certain length from a lower end portion thereof to the contact portion thereof necessary to be displaced elastically by a certain amount in order to maintain the contact pressure at the contact portion. Further, the contact portion is bent into the angular shape so that the apex portion thereof contacts with the mating terminal.

Therefore, a portion situated upper side of the apex portion functions only for guiding the mating connector, without contribution to contacting with the mating connector, the elastic displacement. Moreover, the portion situated upper side of the apex portion extends an entire length of the elastic arm portion.

On the other hand, it becomes difficult to guide the mating terminal successfully when the portion situated upper side of the apex portion is eliminated. When the contact portion lowers a position thereof as maintaining the angular shape thereof, the elastic arm portion shortens the length thereof, resulting in the lower elasticity. The thinner the terminal is made in order to obtain the sufficient elasticity, the weaker the contact pressure becomes.

In view of the problems described above, an object of the present invention is to provide an electrical connector including a terminal enabling a height of the connector to be lowered, by shortening a height of an elastic arm portion thereof while maintaining an adequate length of the elastic displacement arm portion and a contact pressure.

Further objects and advantages of the invention will be apparent from the following description of the invention.

SUMMARY OF THE INVENTION

In order to attain the objects described above, according to an aspect of the present invention, an electrical connector (a connector) includes a housing made of an electrical insulating material and a terminal made by bending a metal strip and disposed in the housing. The terminal includes a held portion for being held in the housing, an elastic arm portion and a connecting portion. The elastic arm portion extends from the held portion. The elastic arm portion includes a contact portion at a distal end portion thereof. The elastic arm portion is displaced elastically when the contact portion is pressed by a mating terminal of a mating connector. The connecting portion extends from another end of the held portion to be connected to a circuit board.

In the connector according to the aspect of the present invention, when the connector is connected to the mating connector, the elastic arm portion is displaced elastically at least in a direction perpendicular to a direction that the connector is connected to the mating connector or a connecting direction when the contact portion is pressed by interfering with the mating connector.

In the connector according to the aspect of the present invention, the elastic arm portion is inclined in a direction for contacting with the mating connector as extending to the distal end portion thereof. Further, the elastic arm portion includes a tapered portion formed by reducing a thickness thereof as being closer to the distal end portion thereof. The contact portion is provided as a boundary zone between the tapered portion and a portion situated next to the tapered portion of the elastic arm portion.

In the connector according to the aspect of the present invention described above, the tapered portion is situated close to the distal end portion of the elastic arm portion. Therefore, the contact portion is situated close to the distal end portion since the contact portion is composed of the boundary zone between the tapered portion and the portion situated next thereto.

When the connector is connected to the mating connector, the mating terminal enters in the connecting direction as contacting slidingly with the tapered portion which guides the mating terminal. The contact portion faces toward the direction perpendicular to the connecting direction since the contact portion is formed as the boundary zone between the tapered portion and the portion situated next thereto. Therefore, the mating terminal interferes with the contact portion, thereby pressing and elastically displacing the contact portion. As a result, the mating terminal contacts with the contact portion with a certain contact pressure as the connector is connected to the mating connector completely.

In the connector according to the aspect of the present invention, it is adequate that the tapered portion is formed in a short region close to an edge of the distal end portion of the elastic arm portion. Therefore, it is possible that the elastic arm portion has a certain length necessary to obtain a sufficient elasticity and the contact pressure against the mating terminal without thinning the thickness thereof. The elastic arm portion thus configured is capable of guiding the mating terminal as well.

In the connector according to the aspect of the present invention, it is preferable that the tapered portion of the elastic arm portion has a rounded shape at an edge portion thereof. Upon being connected to the mating connector, either of the mating terminal or the terminal having the tapered portion thus shaped is not damaged caused by an impact due to a slight misplacement of the mating connector in the direction perpendicular to the connecting direction.

In the connector according to the aspect of the present invention, it is preferable that the elastic arm portion is partially situated in the terminal holding groove of the housing and the contact portion thereof is situated outside the terminal holding groove. It is adequate that only the contact portion of the elastic arm portion is situated outside the terminal holding grove.

Therefore, the elastic arm portion is capable of displacing elastically in the terminal holding groove as the contact portion contacts with the mating terminal. As a result, the elastic arm portion is not damaged by receiving an unfavorable force from the mating terminal. Further, the elastic arm portions next to each other do not contact with each other inadvertently.

As described above, the connector according to the present invention is not similar to the conventional terminal since the terminal thereof made from the metal strip including the contact portion which is not an apex portion formed by bending the metal strip in the thickness direction thereof.

In the aspect of the present invention, the elastic arm portion has the tapered portion formed by crushing so as to reduce the thickness thereof as being closer to the distal end portion thereof. Therefore, the boundary zone between the tapered portion and the portion of the elastic arm portion which is not crushed has a protruding shape. The contact portion is provided as the boundary zone thus shaped.

In the aspect of the present invention, the contact portion is formed in a short region at the distal end portion thereof. Therefore, the elastic arm portion is allowed to have the length necessary to obtain the certain elasticity and the contact pressure against the mating terminal without thinning the thickness thereof. Further, the elastic arm portion is allowed to shorten the entire length thereof, making it possible the connector to lower the height thereof.

DETAILED DESCRIPTION OF THE PREFERRED EMBODIMENTS

Hereunder, an electrical connector according to an embodiment of the present invention will be explained with reference to the accompanying drawings.

Figure 1:
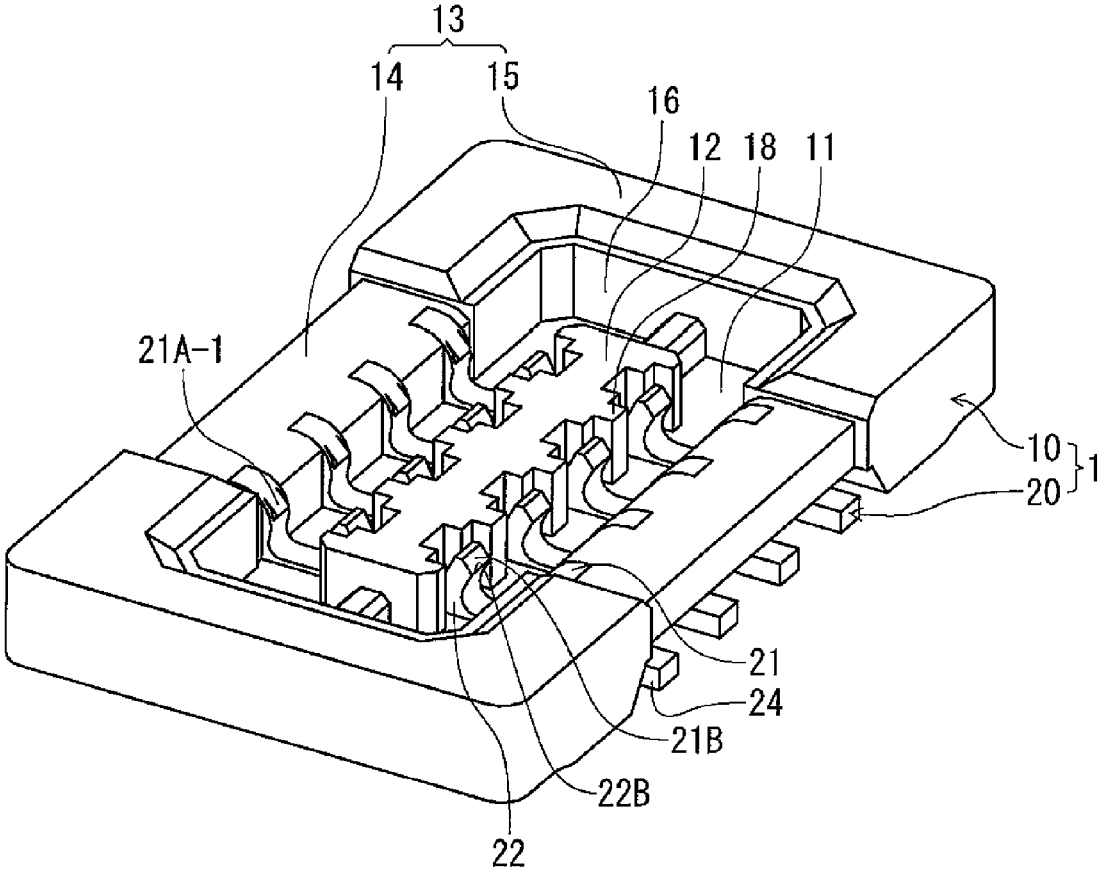
FIG. 1 is a perspective view showing an electrical connector according to an embodiment of the present invention.
Figure 2:
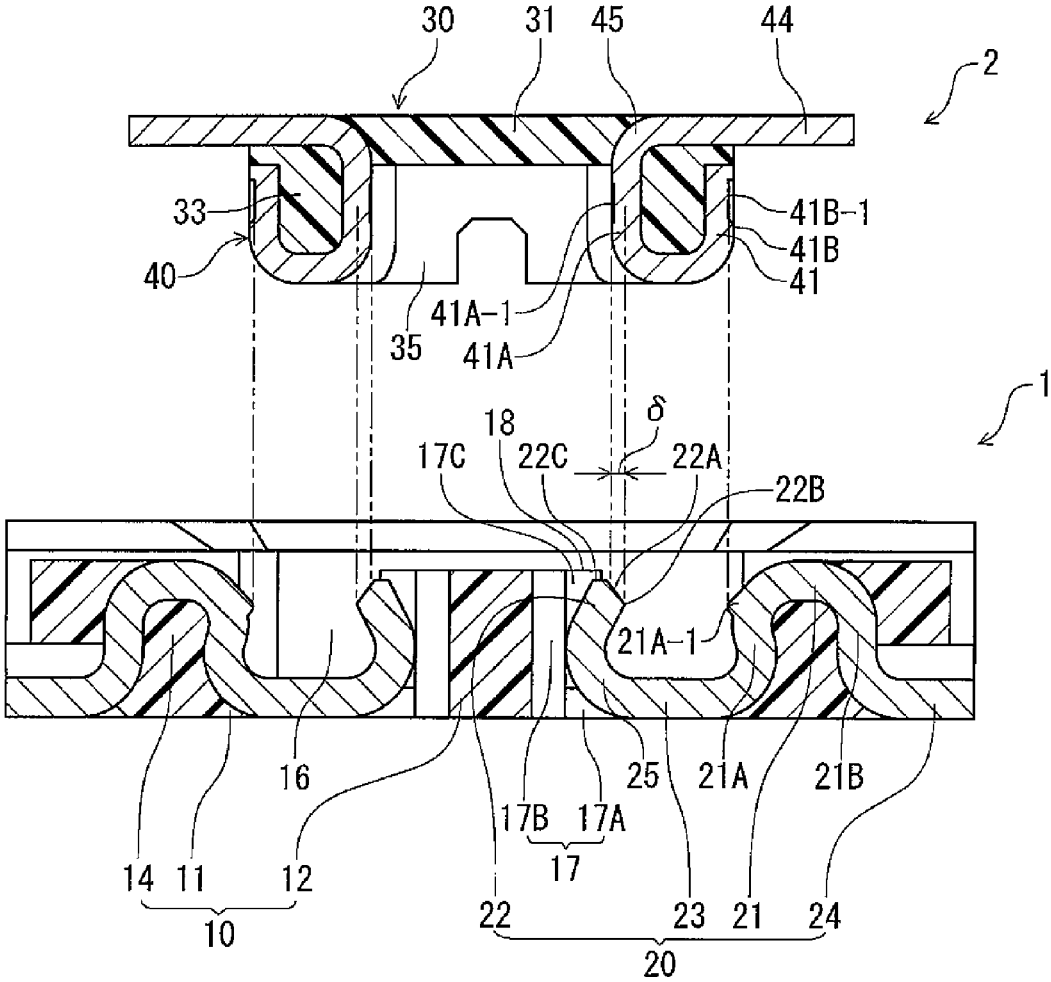
FIG. 2 is a sectional view showing the electrical connector and a mating connector according to the embodiment of the present invention.
Figure 3A:
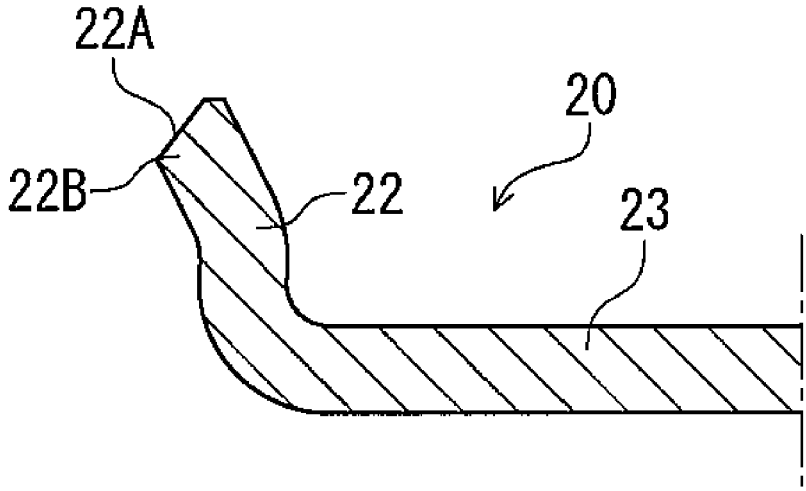
FIGS. 3(A) and 3(B) are sectional views showing a terminal of the electrical connector partially, in a region around a contact portion thereof, according to modified examples of the present invention.
Figure 3B:
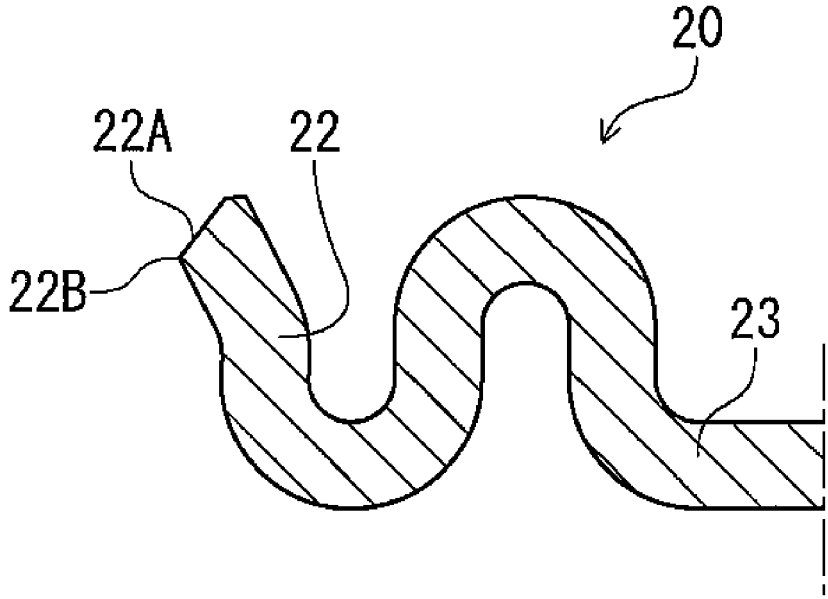

FIG. 1 is a perspective view showing an electrical connector 1 according to an embodiment. FIG. 2 is a sectional view showing the electrical connector 1 and a mating connector 2 in a state of being unconnected to the electrical connector 1. FIGS. 3(A) and 3(B) are sectional views partially showing a main section of a terminal of the electrical connector 1 according to modified examples, respectively.

In the embodiment, the electrical connector 1 (the connector 1) is mounted on a circuit board (not shown) and receives the mating connector 2 (described later) to be connected from an upper direction. The connector 1 includes a housing 10 and a plurality of the terminals 20. The housing 10 has a substantial rectangular parallelepiped shape and made from a synthetic resin. The terminal 20 is made from metal and disposed to be held in the housing 10 in a longitudinal direction of the housing 10.

As shown in FIG. 1, the housing 10 includes a bottom wall 11, a protruding wall portion 12 and a circumferential wall 13 surrounding the protruding wall portion 12. The bottom wall 11 faces a mounting surface of the circuit board and extends in the longitudinal direction, in other words, a terminal disposing direction. The protruding wall portion 12 protrudes from the bottom wall 11 in the upper direction as well as extending in the longitudinal direction. The circumferential wall 13 includes a pair of sidewalls 14 facing each other and extending in the longitudinal direction and a pair of end walls 15.

In the embodiment, the end wall 15 is connected to end portions of the two sidewalls 14 and extends in a short direction which is perpendicular to the longitudinal direction. The circumferential wall 13 and the protruding wall portion 12 forms a receptacle recess portion 16 having an annular rectangle shape for receiving a fitting portion of the mating connector 2. The sidewall 14 holds the terminal 20 in the longitudinal direction thereof with a predetermined interval. The housing 10 will be explained again later, in relation to the terminal 20.

The terminal 20 is formed by bending a metal strip in a thickness direction thereof. The terminal 20 has an approximate lateral S-shape including a U-shape portion and an upside-down U-shape portion. The terminals 20 are held in the sidewall 14 of the housing 10, forming two rows so as to be symmetrical about the protruding wall portion 12. The terminal 20 includes the held portion 21, the elastic arm portion 22, the base portion 23 and a connecting portion 24. The held portion 21 has the upside-down U-shape held by the sidewall 14 of the housing 10.

In the embodiment, the elastic arm portion 22 extends in a vertical direction at a position close to the protruding wall portion 12 in the short direction and an upper end portion thereof is a free end. The base portion 23 extends along the bottom wall 11 of the housing 10 in the short direction. Further, the base portion 23 connects one leg portion of the held portion 21 (an inner leg portion 21A, described later) to the elastic arm portion 22 at a lower end position thereof. The connecting portion 24 extends from another leg portion of the held portion 21 (an outer leg portion 21B, described later) to outside the housing 10. The connecting portion 24 is soldered to a corresponding circuit portion on the circuit board (not shown). As shown in FIGS. 1 and 2, the terminal 20 is held in the housing 10 by being molded integrally with the housing 10 at the held portion 21 thereof.

Obviously, the connecting portion 24 extends as necessary as being soldered to the circuit board. In the embodiment, the terminal 20 and the housing 10 are molded integrally. Configurations of holding the terminal are not limited to the case described above. The terminal may be held in the housing by being forcibly inserted into the sidewall.

As shown in FIG. 2, the held portion 21 has the upside-down U-shape as described above and includes the inner leg portion 21A and the outer leg portion 21B. The inner leg portion 21A extends along an inner surface of the sidewall 14 and the outer leg portion 21B situated at a position closer to an outer surface of the sidewall 14. The inner leg portion 21A includes a locking portion 21A-1 at a position close to an upper end thereof. The locking portion 21A-1 protrudes into the receptacle recess portion 16 so as to face a contact portion 22B (described later).

In the embodiment, the locking portion 21A-1 not only maintains the connector 1 and the mating connector 2 being connected to each other by engaging a locked portion 41B-1, formed by caving in a mating terminal 40 of the mating connector 2, but also helps the contact portion 22B by contacting and conducting electrically with the locked portion 41B-1.

As shown in FIGS. 1 and 2, the held portion 21 is held in the sidewall 14 so as to stride over the sidewall 14, being buried in the sidewall 14 by being molded integrally. The inner leg portion 21A of the held portion 21 contacts with the sidewall 14 with a lower surface and side edges thereof. The outer leg portion 21B of the held portion 21 is buried in the sidewall 14 entirely at an upper half portion thereof and exposes an outer surface thereof at a lower half portion thereof. A highest portion of the held portion 21 connecting the inner leg portion 21A and the outer leg portion 21A exposes a surface thereof at a half portion thereof situated inside the connector while being buried entirely in the sidewall 14 at a half portion thereof situated outside the connector.

In the embodiment, the connecting portion 24 is formed by being bent and extends in a horizontal direction, from a lower end portion of the outer leg portion 21B toward outside the housing 10. As shown in FIGS. 1 and 2, the connecting portion 24 is situated approximately in the same height with a lower surface of the bottom wall 11 and capable of being soldered to the corresponding circuit portion on the circuit board.

The elastic arm portion 22 extends in the upper direction along the protruding wall portion 12 thorough a transition portion 25 which is formed by being bent at a position between the elastic arm portion 22 and the base portion 23. The elastic arm portion 22 is capable of elastic displacement in the short direction by being bent in the thickness direction thereof. The elastic arm portion 22 is inclined toward the sidewall 14 as extending in the upper direction toward the free end. The elastic arm portion 22 is thus inclined so as to contact with the mating terminal 40 and have more interference with the mating terminal 40 as the mating connector 2 is inserted when the connector 1 is connected to the mating connector 2.

The elastic arm portion 22 includes a tapered portion 22A at a position close to the upper end portion thereof. The tapered portion 22A is formed by reducing a thickness thereof as being closer to the upper end portion of the elastic arm portion 22.

As described above, the elastic arm portion 22 is inclined toward the inner leg portion 21A as extending to the upper direction. Therefore, the tapered portion 22A forms a protruding shape at a boundary zone with a portion situated next to a lower end thereof. The boundary zone having the protruding shape thus formed functions as the contact portion 22B.

As shown in FIG. 2, the contact portion 22B has an interference 6 with the mating terminal 40 in lateral direction in FIG. 2, in other words, in a direction perpendicular to a connecting direction (a direction the connector 1 is connected to the mating connector 2).

In addition, as shown in FIG. 2, the mating terminal 40 has a surface thereof having the interference 6 in a region corresponding to the tapered portion 22A. Moreover, the elastic arm portion 22 includes a beveled portion 22C at an upper edge portion of the tapered portion 22A, in order to lower a height of the connector 1 furthermore. The beveled portion 22C may have either of a curved surface or a flat surface. The beveled portion 22C only has to be situated in a region close to an upper end edge of the elastic arm portion 22. It is preferable that the beveled portion 22C is situated within a minimum region capable of guiding the mating terminal 40.

The housing 10 further includes a terminal holding groove 17 in an inner surface of the receptacle recess portion 16. The terminal holding groove 17 holds the U-shape portion of the terminal 20. The terminal holding groove 17 includes a bottom wall groove portion 17A provided on the bottom wall 11 for holding the base portion 23 of the terminal 20 and a protruding wall groove portion 17B provided on the protruding wall portion 12 for holding the elastic arm portion 22. The bottom wall groove portion 17A and the protruding wall groove portion 17B communicate with each other.

In the embodiment, the terminal holding groove 17 further includes a side groove portion 17C on both edges of the protruding wall groove portion 17B. The side groove portion 17C is not deeper than the protruding wall groove portion 17B. A pair of the side groove portions 17C next to each other forms a regulating portion 18 for regulating a corresponding portion of the mating connector 2 in a direction perpendicular to the terminal disposing direction. Accordingly, the elastic arm portion 22 is situated between the side groove portions 17C and displaced elastically into the protruding wall groove portion 17B as the connector 1 is connected to the mating connector 2.

As the connector 1 is connected to the mating connector 2, the elastic arm portion 22 partially moves inside the protruding wall groove portion 17B while the contact portion 22B and adjacent thereof are situated outside the side groove portion 17C having a sufficient contact pressure with the mating terminal 40. In the embodiment, the regulating portion 18 is provided on both sides of each of the protruding wall groove portion 17B.

It is preferable that the regulating portion 18 is provided at positions corresponding to arbitrary two or more of the protruding wall groove portion 17B only, instead of being provided at a position corresponding to each of the protruding wall groove portion 17B. Thereby, it is possible to regulate the mating connector certainly at least two positions having a distance in the longitudinal direction by the regulating portion thus provided. The regulating portion may be provided at both ends of the protruding wall in the longitudinal direction.

The tapered portion 22A is able to be formed by crushing locally the upper end portion of the elastic arm portion 22 with an appropriate tool. The tapered portion 22A is also able to be formed by other method, for example, by grinding the upper end portion of the elastic arm portion 22.

The mating terminal 40 is made by bending a metal strip in a thickness direction thereof and held in a housing 30 being arranged in two rows in a short direction (the lateral direction in FIG. 2) of the housing 30 so as to be symmetrical. The mating terminal 40 includes an engaging portion 41, an inner leg portion 41A, a connecting portion 44 and a transition portion 45.

In the embodiment, the engaging portion 41 has a U-shape and the inner leg portion 41A is one of two leg portions of the engaging portion 41 situated closer to a receptacle recess portion 35. The engaging portion 41 is held with a sidewall 33. The connecting portion 44 extends in the short direction from an upper end of the inner leg portion 41A through the transition portion 45 which is formed by being bent. The connecting portion 44 is soldered to a corresponding circuit portion of a circuit board. As shown in FIG. 2, the mating terminal 40 is held in the housing 30 by being molded integrally at the engaging portion 41 and the transition portion 45 thereof.

The engaging portion 41 is buried in the sidewall 33 so as to stride the sidewall 33 from a lower direction. The sidewall 33 holds side edges and an inner surface of the engaging portion 41. An outer surface of the engaging portion 41 being exposed from the sidewall 33 forms a smooth surface with an outer surface of the sidewall 33. The engaging portion 41 has a slightly larger size in the short direction than a distance between the contact portion 22B and the locking portion 21A-1 of the terminal 20 of the connector 1.

Accordingly, as described above, the contact portion 22B has the interference 6 with the mating terminal 40. The engaging portion 41 further includes a corresponding contact portion 41A-1 provided at a position closer to a bottom wall 31 (an upper side in FIG. 2), on a plate surface of the inner leg portion 41A which is situated closer to the receptacle recess portion 35. The corresponding contact portion 41A-1 contacts with the contact portion 22B of the terminal 20 of the connector 1 with the contact pressure, as the connector 1 and the mating connector 2 are connected to each other.

In the embodiment, the corresponding contact portion 41A-1 has a slightly recessed shape, thereby locking the contact portion 22B as contacting with the contact portion 22B of the terminal 20. Furthermore, the engaging portion 41 includes the locked portion 41B-1 having a recessed shape provided at a position closer to the bottom wall 31 (the upper side in FIG. 2) on an outer surface of an outer leg portion 41B. The outer leg portion 41B is one of the two leg portions of the engaging portion 41 being situated distant to the receptacle recess portion 35. The locked portion 41B-1 engages the locking portion 21A-1 of the terminal 20.

As shown FIG. 2, the connecting portion 44 is situated in approximately the same height with a lower surface (an upper surface in FIG. 2) of the bottom wall 31. The connecting portion 44 is to be soldered to the corresponding circuit portion of the circuit board.

Hereunder, operation of connecting the connector 1 to the mating connector 2 will be explained. First, the connector 1 and the mating connector 2 are soldered to the corresponding circuit portions of the circuit boards, respectively.

Next, as shown in FIG. 2, the connector 1 is placed so that the receptacle recess portion 16 thereof opens toward the upper direction and the mating connector 2 is placed over the connector 1 so that the receptacle recess portion 35 thereof opens toward the lower direction. Next, the mating connector 2 is moved in the lower direction. Being regulated by the regulating portion 18 formed in the protruding wall portion 12, the fitting portion of the mating connector 2 is inserted in the receptacle recess portion 16 of the connector 1.

Accordingly, the engaging portion 41 of the mating terminal 40 of the mating connector 2 moves in the connecting direction then abuts against the tapered portion 22A of the terminal 20 of the connector 1 with a curved portion of the U-shape thereof. Being guided by the tapered portion 22A in the connecting direction, the engaging portion 41 opens a space between the contact portion 22B and the locking portion 21A-1 of the terminal 20 of the connector 1.

As a result, the elastic arm portion 22 of the terminal 20 is displaced elastically into the protruding wall groove portion 17B of the terminal holding groove 17 as the contact portion 22B is pushed into the protruding wall groove portion 17B. As the engaging portion 41 moves further, the contact portion 22B contacts with the corresponding contact portion 41A-1 of the engaging portion 41 with the contact pressure.

In addition, the locking portion 21A-1 engages the locked portion 41B-1 of the engaging portion 41 in the vertical direction. Consequently, the terminals of the connectors are conducted electrically with each other as well as locking each other. Thereby, the operation connecting the connector 1 to the mating connector 2 is completed.

The present invention is able to modify in various ways, not limited to the embodiment described above and shown in FIGS. 1 and 2.

The contact portion is formed as the boundary zone between the tapered portion and the portion situated next thereto. As opposed to a case that the contact portion is provided on the upper end of the elastic arm portion 22 so as to face the base portion 23 of the terminal 20 as shown in FIGS. 1 and 2, it is possible to provide the contact portion so as to face an opposite side of the base potion 23.

As compared to a case shown in FIGS. 1 and 2, when the contact portion of the mating connector is inserted into a side where the base portion is not provided as shown in FIGS. 3(A) and 3(B), the elastic arm portion 22 of the terminal 20 may include the tapered portion 22A and the contact portion 22B at the upper end thereof, on the side where the base portion 23 is not provided.

The disclosure of Japanese Patent Application No. 2011-031566 filed on Feb. 17, 2011, is incorporated in the application by reference.

While the invention has been explained with reference to the specific embodiments of the invention, the explanation is illustrative and the invention is limited only by the appended claims.

What is claimed is:

1. An electrical connector to be connected to a mating connector from above, comprising:

a housing formed of an insulation material, said housing including a pair of sidewalls and a protruding wall portion between the sidewalls; and a terminal disposed in the housing, said terminal being formed in a curved shape bent in a thickness direction thereof, said terminal including a held portion fixed to the housing, an elastic arm portion, and a connection portion to be connected to a circuit board, wherein said held portion is formed in a U-character shape so that the held portion is held in one of the sidewalls, said elastic arm portion includes a contact portion and a slant surface portion, said slant surface portion has a thickness decreasing toward a distal end portion of the elastic arm portion, said protruding wall portion including a terminal holding groove, said slant surface portion and said contact portion are situated outside the terminal holding groove, and said contact portion is disposed adjacent to the slant surface portion.

2. The electrical connector according to claim 1, wherein said elastic arm portion has a curved portion at an edge of the slant surface portion.

3. The electrical connector according to claim 1, wherein said held portion includes a locking portion opposite to the elastic arm portion so that the locking portion engages with the mating connector when the mating connector is connected to the electrical connector from above.

4. The electrical connector according to claim 1, wherein said elastic arm portion has a plate thickness substantially same as that of the held portion and the connection portion.

5. The electrical connector according to claim 1, wherein said held portion includes a locking portion that faces the slant surface portion.

6. The electrical connector according to claim 1, wherein said slant surface portion is arranged so that the mating connector contacts with the slant surface portion before the mating connector contacts with the contact portion.

* * * * *